US006223509B1

(12) United States Patent
Girault

(10) Patent No.: US 6,223,509 B1
(45) Date of Patent: May 1, 2001

(54) SADDLE TREE

(75) Inventor: Bernard Girault, Etobicoke (CA)

(73) Assignee: Pegase Saddlery Inc., Nobleton (CA)

( * ) Notice: Subject to any disclaimer, the term of this patent is extended or adjusted under 35 U.S.C. 154(b) by 0 days.

(21) Appl. No.: 09/382,801

(22) Filed: Aug. 25, 1999

Related U.S. Application Data

(63) Continuation-in-part of application No. 09/215,962, filed on Dec. 18, 1998, now abandoned.

(51) Int. Cl.[7] ..... B68C 1/06
(52) U.S. Cl. ..... 54/44.7; 54/44.4
(58) Field of Search ..... 54/44.7, 44.1, 54/44.4

(56) References Cited

U.S. PATENT DOCUMENTS 497,665 * 5/1893 Hotze .
4,965,988 * 10/1990 Anderson ..... 54/44.7
5,517,808 * 5/1996 Schleese ..... 54/44.6

* cited by examiner

*Primary Examiner*—Charles T. Jordan
*Assistant Examiner*—Yvonne R. Abbott
(74) *Attorney, Agent, or Firm*—Robert F. Delbridge

(57) ABSTRACT

A saddle tree for a horse saddle has an arched body portion shaped to fit across a horse's back, a pair of laterally-spaced fork members which project downwardly from opposite sides of the arched body portion so as to extend downwardly on opposite sides of a horse's body when in use, and a pair of laterally-spaced independently resiliently deflectable spring members projecting rearwardly from the arched body portion. The spring members are of blade-like shape curved to conform with the shape of a horse's back and have a length sufficient to extend along at least eight vertebrae when in use and a lateral spacing causing at least laterally-inner rear-edge portions thereof to rest on the relevant vertebrae when in use.

3 Claims, 4 Drawing Sheets

SADDLE TREE

RELATED APPLICATION

This application is a continuation-in-part of application Ser. No. 09/215,962 filed Dec. 18, 1998, now abandoned.

FIELD OF THE INVENTION

This invention relates to saddle trees, that is to say frames which are used in horse saddles to provide strength and shape therefor.

BACKGROUND OF THE INVENTION

Saddle trees have been used in horse saddles for very many years and many different designs have been proposed, it being necessary to consider the anatomy of the horse, the anatomy of the rider and the balance of the saddle and the rider on the horse's body. Typical saddle trees are shown, for example, in U.S. Pat. No. 4,965,988 (Anderson), PCT Application No. PCT/GB97/02192 (Huggins), and PCT Application No. PCT/US97/20013 (Coffin). However, known saddle trees do not satisfactorily meet all of the above-mentioned desired criteria with respect to the rider.

It is therefore an object of the present invention to provide an improved saddle tree which enables a saddle incorporating the tree to more clearly meet such desired criteria.

SUMMARY OF THE INVENTION

According to the present invention, a saddle tree has an arched body portion shaped to fit over a horse's back, a pair of laterally-spaced fork members which project downwardly from opposite sides of the arched body portion so as to extend downwardly on opposite sides of a horse's body when in use and a pair of laterally-spaced independently resiliently deflectable spring members projecting rearwardly from the arched body portion. The spring members are of blade-like shape curved to conform with the shape of a horse's back and have a length sufficient to extend along at least eight vertebrae when in use and a lateral spacing causing at least laterally-inner rear-edge portions thereof to rest on the relevant vertebrae when in use.

It has been found that a horse saddle incorporating a saddle tree in accordance with the invention, particularly because of the length and spacing of the spring members, much more satisfactorily meets the desired criteria than horse saddles with previously-known saddle trees.

The spring members may have laterally-inner edges which, in plan view, are substantially parallel and laterally-outer edges which diverge in a curved manner from the arched body portion to a maximum just beyond halfway along their length and then converge towards their rear ends.

DESCRIPTION OF THE DRAWINGS

Embodiments of the invention will now be described, by way of example, with reference to the accompanying drawings, of which.

DESCRIPTION OF PREFERRED EMBODIMENTS

Figure 1:
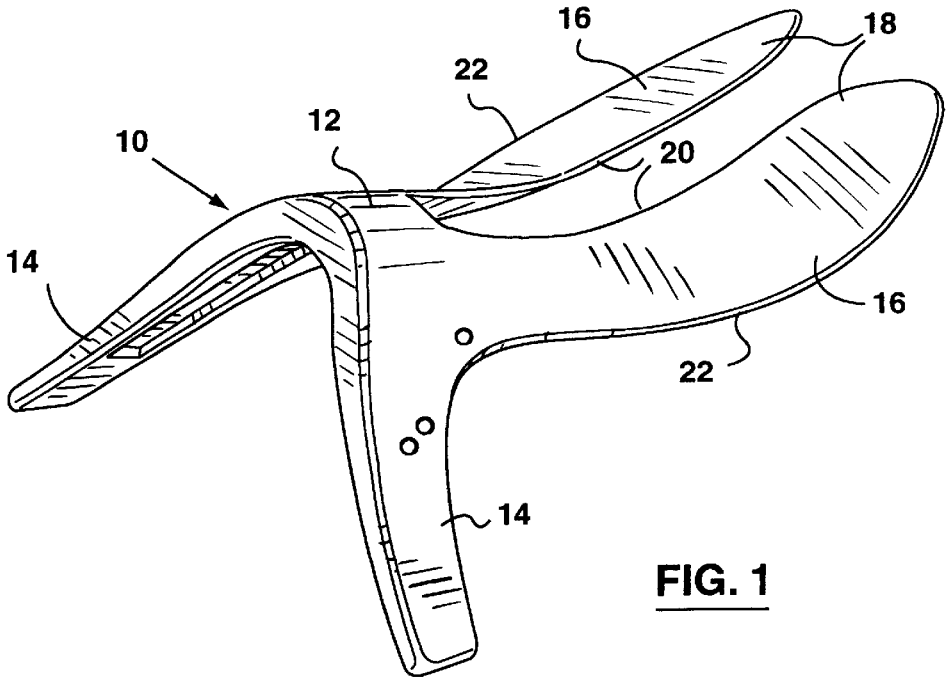
FIG. 1 is a perspective view of a saddle tree in accordance with one embodiment of the invention.
Figure 2:
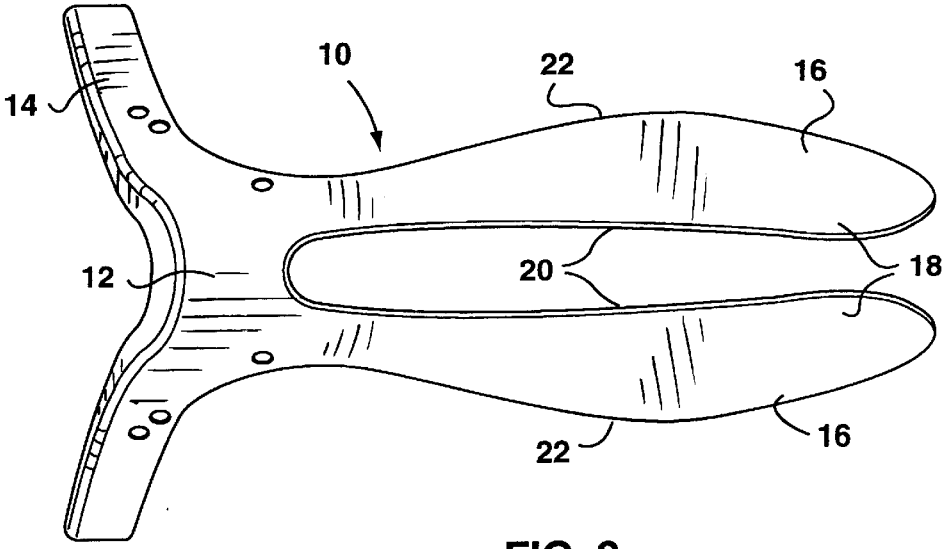
FIG. 2 is a plan view thereof.
Figure 3:
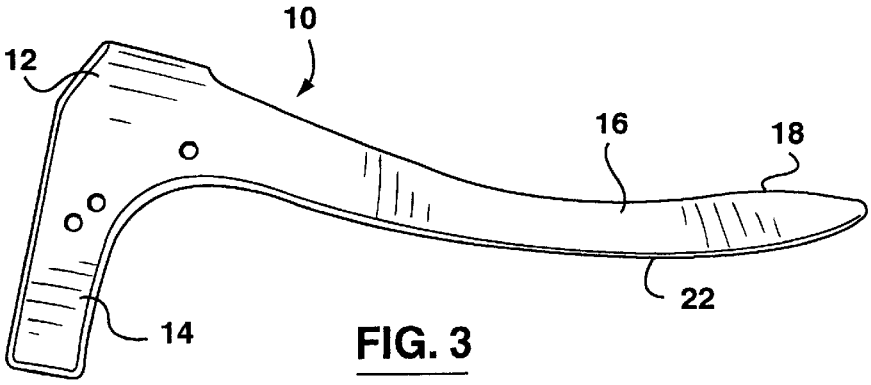
FIG. 3 is a side view thereof.

Referring first to FIGS. 1 to 3, a saddle tree 10 for a horse saddle is formed as an integral molding of suitable synthetic plastic material and has an arched body 12 shaped to fit across a horse's back, a pair of laterally-spaced fork members 14 projecting downwardly from opposite sides of the arched body portion 12 so as to extend downwardly on opposite sides of the horse's back, and a pair of laterally-spaced independently resiliently deflectable spring members 16 extending rearwardly from the arched body portion 12.

The spring members 16 are of blade-like shape curved to conform with the shape of a horse's back and having a length sufficient to extend along about eight vertebrae thereof and a lateral spacing such that at least laterally-inner rear edge portions 18 thereof to rest on the vertebrae (as will be described in more detail later).

The spring members 16 have laterally-inner edges 20 which, in plan view (see FIG. 2), are substantially parallel and laterally-outer edges 22 which diverge in a curved manner from the arched body portion 12 to a maximum just beyond halfway along the length thereof and then curved towards their rear ends. The spring members 16 have a length of about 13 inches and a spacing between the inner edges 20 of about 1.25 to 1.5 inches. The maximum width of each spring member 16 is approximately 2.75 inches.

Figure 4:
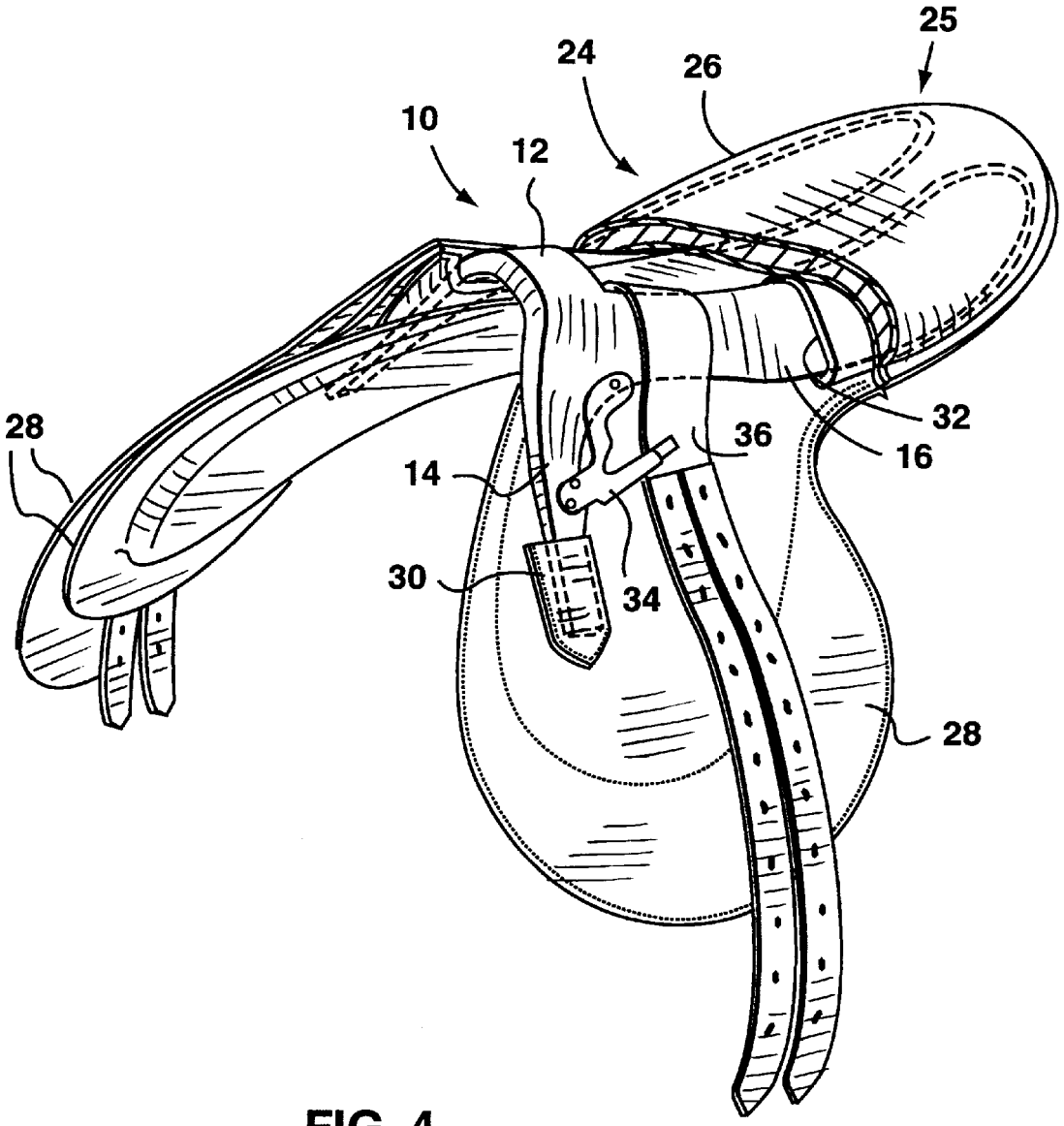
FIG. 4 is a perspective view, partly broken away, of a horse saddle incorporating the saddle tree shown in FIGS. 1 to 3.

FIG. 4 shows the saddle tree 10 incorporated in a saddle 24. The saddle 24 has a conventional flexible leather saddle portion 25 with a seat part 26 and side flaps 28 extending downwardly from opposite sides thereof so as to extend downwardly on opposite sides of a horse's back. The fork members 14 extend into pockets 30 provided on the side slaps 38 and the spring members 15 extend into pockets 32 provided in the rear portion of the seat part 26 rearwardly of the side flaps 28. Stirrup-mounting brackets 34 are secured to the fork members 14 and arched body portion 12 and girth straps 36 are mounted on the spring member 16 adjacent the arched body portion 12.

Figure 5:
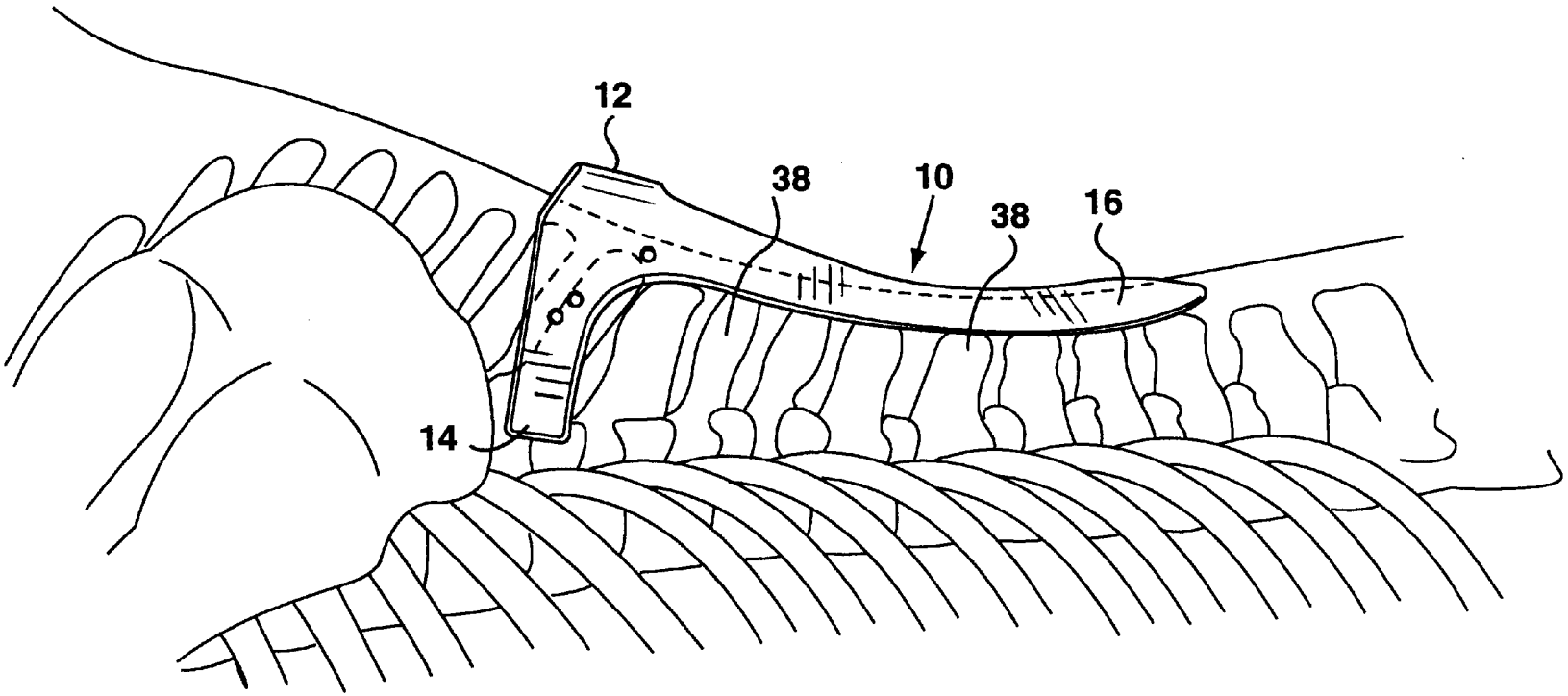
FIG. 5 is a diagrammatic side view showing how the saddle tree of FIGS. 1 to 3 sits on a horse's back.

FIG. 5 is a diagrammatic view showing how the saddle tree 10 sits on a horse's back and it will be noted that the spring members 16 extend over eight vertebrae 38.

It has been found that a saddle tree, in accordance with the invention, such as the saddle tree 10 described above, enables a saddle incorporating the tree to be a substantial improvement over prior art saddles, both for the horse and for the rider.

For example, there is less likelihood of the saddle moving forward during use and causing the saddle tree to interfere with movement of the horse's shoulder blades, as can happen with prior art saddles with short spring members such as described in U.S. Pat. No. 4,965,988 (Anderson) which only extend over about three vertebrae.

Figure 6:
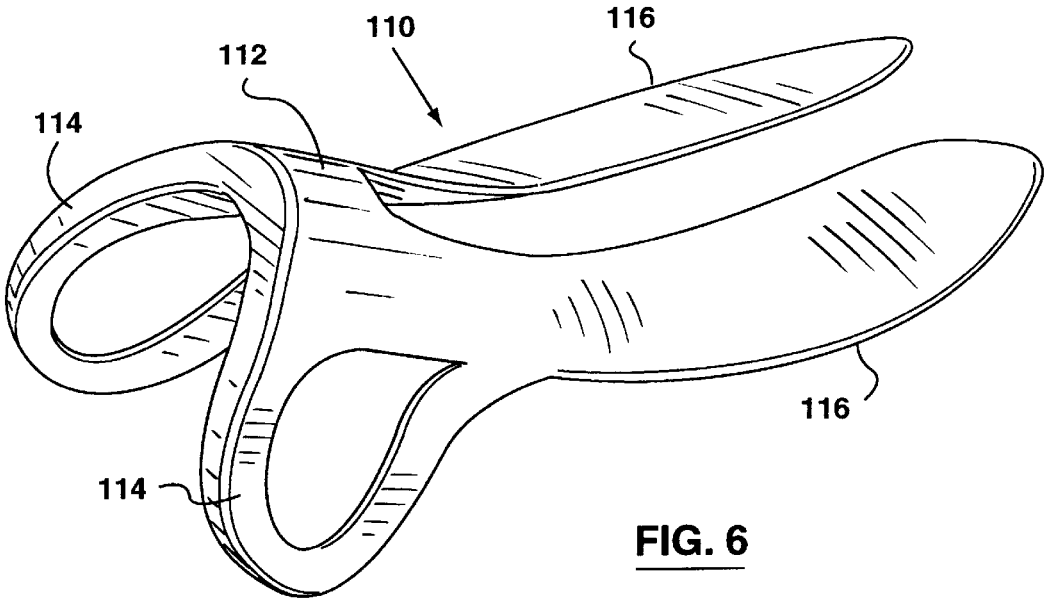
FIG. 6 is a perspective view of a saddle tree in accordance with a second embodiment of the invention.
Figure 7:
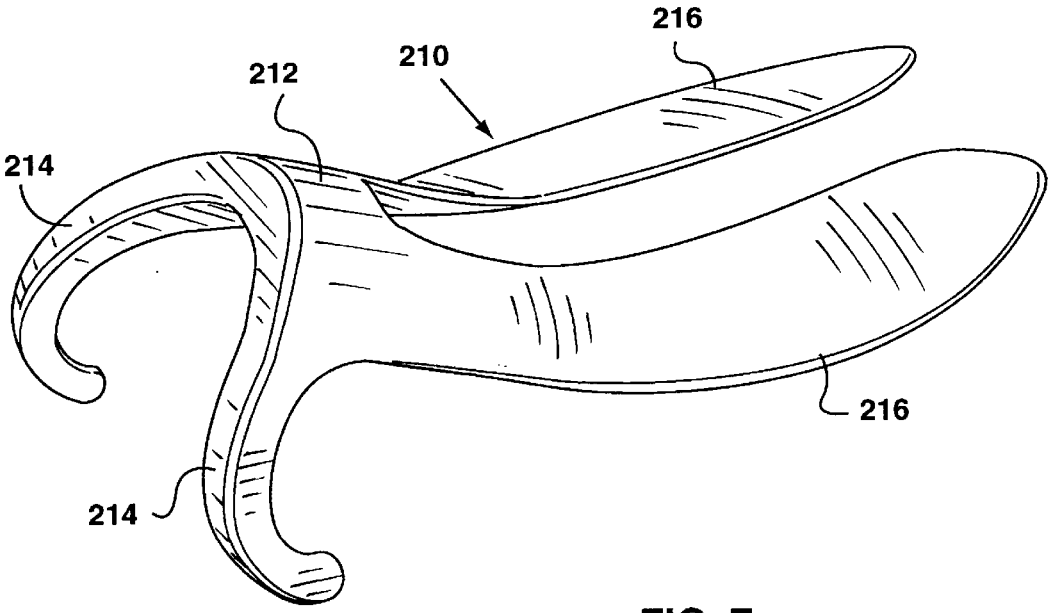
FIG. 7 is a similar view of a saddle tree in accordance with a third embodiment of the invention.

Other embodiments of saddle trees in accordance with the invention will be readily apparent to a person skilled in the art. For example, as shown in FIG. 6, the fork members 114 of the saddle tree 110 may be loop-shaped, with the spring members 116 being substantially the same as in the previously-described embodiment. As shown in FIG. 7, the fork members 214 of the saddle tree 210 may be hook-shaped, again with the spring members 216 being the same as before.

The scope of the invention is defined in the appended claims.

What is claimed is:

1. A saddle tree for a horse saddle, said tree having:

an arched body portion shaped to fit across a horse's back, a pair of laterally-spaced fork members which project downwardly from opposite sides of the arched body portion so as to extend downwardly on opposite sides of a horse's body when in use, and a pair of laterally-spaced independently resiliently deflectable spring members projecting rearwardly from the arched body portion, said spring members being of blade-like shape curved to conform with the shape of a horse's back and having a length sufficient to extend along at least eight vertebrae when in use and a lateral spacing causing at least laterally-inner rear-edge portions thereof to rest on the relevant vertebrae when in use, the spring members having in plan view laterally-inner edges which are substantially parallel and laterally-outer edges which diverge in a curved manner from the arched body portion to a maximum just beyond halfway along their length and then converge towards their rear ends.

2. A horse saddle having:

a flexible saddle portion including a seat part and side flaps extending downwardly from opposite sides thereof, the seat part having a rear portion extending rearwardly of the side flaps, each side flap having a pocket and the rear portion of the seat part having pockets extending rearwardly of the side flaps, and a saddle tree having an arched body portion shaped to fit across a horse's back, a pair of laterally-spaced fork members which project downwardly from opposite sides of the arched body portion so as to extend downwardly on opposite sides of a horse's body when in use, and a pair of laterally-spaced independently resiliently deflectable spring members projecting rearwardly from the arched body portion, said spring members being of blade-like shape curved to conform with the shape of a horse's back and having a lateral spacing causing at least laterally-inner rear-edge portions thereof to rest on the relevant vertebrae of a horse's back when in use, said fork members extending into respective pockets of the side flaps, and said spring members extending into respective pockets in the rear portion of the seat part rearwardly of the side flaps.

3. A saddle according to claim 2 wherein in plan view the spring members of the saddle tree have laterally-inner edges which are substantially parallel and laterally-outer edges which diverge in a curved manner from the arched body portion to a maximum just beyond halfway along their length and then converge towards their rear ends.

* * * * *